US007217033B2

(12) United States Patent
Pritchard

(10) Patent No.: US 7,217,033 B2
(45) Date of Patent: May 15, 2007

(54) ASEPTIC PACKAGING FOR FOODS AND SYSTEMS AND METHODS FOR ASEPTICALLY PACKAGING FOODS

(75) Inventor: Barry Pritchard, Nazareth, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

(21) Appl. No.: 10/844,651

(22) Filed: May 13, 2004

(65) Prior Publication Data

US 2005/0252176 A1 Nov. 17, 2005

(51) Int. Cl.
*B65D 30/00* (2006.01)
*B65D 85/00* (2006.01)

(52) U.S. Cl. ..... 383/37; 383/210.1; 383/211; 206/390

(58) Field of Classification Search ..... 383/37, 383/38, 211; 206/390, 554, 820; 53/469
See application file for complete search history.

(56) References Cited

U.S. PATENT DOCUMENTS 2,444,685 A * 7/1948 Waters ..... 493/196
3,481,100 A 12/1969 Bergstrom
3,532,571 A 10/1970 Ausnit
3,761,013 A 9/1973 Schuster
3,783,581 A 1/1974 Pierce
3,819,106 A * 6/1974 Schuster ..... 206/439
3,884,012 A 5/1975 Ernstsson et al.
3,938,658 A 2/1976 Rohde
3,947,249 A 3/1976 Egger
4,008,851 A 2/1977 Hirsch
4,022,324 A 5/1977 Schuster
4,035,981 A 7/1977 Braun et al.
4,057,144 A 11/1977 Schuster
4,194,622 A 3/1980 Lewis
4,223,512 A 9/1980 Buchner
4,290,467 A * 9/1981 Schmidt ..... 383/9
4,401,213 A * 8/1983 Lerner ..... 206/205
4,436,567 A * 3/1984 Weikert ..... 156/158
4,494,357 A 1/1985 DiGeronimo
4,524,563 A 6/1985 Sassi
4,686,814 A 8/1987 Yanase
4,765,118 A 8/1988 Akutsu et al.
4,782,646 A 11/1988 Nantin
4,945,713 A * 8/1990 Widenback ..... 53/459
4,979,933 A 12/1990 Runge
4,981,374 A * 1/1991 Rutter et al. ..... 383/37
5,120,993 A 6/1992 Tsay et al.
5,129,212 A * 7/1992 Duffey et al. ..... 53/426
5,210,993 A 5/1993 van Boxtel
5,221,567 A * 6/1993 Baker ..... 428/43
5,228,271 A 7/1993 Wallace
5,237,799 A 8/1993 van Boxtel
5,310,262 A 5/1994 Robison et al.
5,378,226 A 1/1995 Hanifl et al.
5,419,437 A * 5/1995 Huseman ..... 206/554
5,551,781 A 9/1996 Wilkes et al.
5,606,847 A 3/1997 Joensson et al.

(Continued)

*Primary Examiner*—Robin A Hylton
(74) *Attorney, Agent, or Firm*—Caesar, Rivise, Bernstein, Cohen & Pokotilow, Ltd.

(57) ABSTRACT

Flexible packages for use in an aseptic filling and sealing apparatus and systems incorporating the packages and apparatus. The packages are formed of a flexible material and include an openable line so that the package can be opened, filled and sealed with a product under aseptic conditions.

9 Claims, 5 Drawing Sheets

U.S. PATENT DOCUMENTS 5,776,045 A 7/1998 Bodolay et al.
5,868,244 A 2/1999 Ivanov et al.
5,971,155 A * 10/1999 Liang ..... 206/554
6,070,397 A 6/2000 Bachhuber
6,079,184 A 6/2000 Cassou et al.
6,085,491 A 7/2000 Bois
6,098,800 A 8/2000 Bennish, Jr. et al.
6,162,158 A 12/2000 Mercer et al.
6,234,310 B1 * 5/2001 Goldhaber ..... 206/438
6,413,350 B1 7/2002 Boschi
6,419,825 B1 7/2002 Hahmann et al.
6,510,669 B1 1/2003 Bellei et al.
6,779,318 B2 * 8/2004 Wang ..... 53/410
6,827,490 B2 * 12/2004 Baker ..... 383/37
2003/0014945 A1 1/2003 Danby

* cited by examiner 20
20'
24
36
38A
38B
42
44
26
28
P
34
40
22A
22B

ASEPTIC PACKAGING FOR FOODS AND SYSTEMS AND METHODS FOR ASEPTICALLY PACKAGING FOODS

CROSS REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

BACKGROUND OF THE INVENTION

1. Field of Invention

This invention relates generally to aseptic packages for food products and systems and methods for aseptically packaging food products.

2. Description of Related Art

The aseptic packaging of processed products, such as foods, using flexible packaging materials, e.g., polymeric films, is commonly accomplished by various techniques. One such technique is sometimes referred to as a "bag-in-box." In that technique aseptically processed products are filled by a machine into irradiated bags through a multi-component spout that is integral with the bag. Usually the spout is on the bag only to facilitate filling and thus brings no value to the finished package. The other common technique is accomplished on a "form, fill and seal" apparatus, wherein roll stock is used to produce the pouches.

While the prior art techniques and packages used thereby are generally suitable for their intended purposes they nevertheless leave much to be desired from one or more of the following standpoints, speed of operation, ability to handle a range of package sizes and shapes, complexity of the packages (e.g., necessity for an otherwise non-functional spout as a part of the package to effect its filling), susceptibility to leakage of the resulting packages.

In U.S. Pat. No. 5,210,993, whose disclosure is also incorporated by reference herein, there is disclosed a fill and seal machine for sealing plural pouches of a saddle-bag type configuration. Pouches of that type are disclosed in U.S. Pat. No. 5,237,799, whose disclosure is also incorporated by reference herein. A machine utilizing the teachings of those patents is commercially available from the assignee of this invention under the trade designation GL90. That machine is particularly suitable for the food-service industry since it can be used to fill flexible packages with a variety of products that are thermally processed after filling to render them shelf-stable. For example, the GL90 machine is versatile enough to be used in what are referred to as "hot-fill and hold" processes to create shelf-stable products. Products that fall into this category are high acidic, e.g., pH of 4.3 or lower, products and low water activity formulations. As presently configured the GL90 machine is not suitable to package low or high acid aseptically processed products at ambient temperatures direct from the process.

Numerous patents disclose aseptically sealed flexible packages and systems and methods for aseptically sealing products in flexible packages. For example, U.S. Pat. No. 4,194,622 (Lewis) discloses a sterilizable package wherein a slit extends along the front thereof from one side to the other, close to the bottom of the package. An adhesive layer is deposited over the entire length of the slit. A protective strip is disposed over the adhesive layer in order to protect it, thereby also sealing the slit. An object is inserted into the package by removing the strip and inserting the object through the slit. The package is sealed by folding it along a fold line located slightly above the adhesive to bring the adhesive into contact with the front of the package. The package is then sterilized.

U.S. Pat. No. 3,938,658 (Rohde) discloses a sterile pouch in which a film is drawn off a first roll and a narrow porous strip is drawn off a second roll. Spaced apart slits are provided in the film and the porous strip is superimposed upon and sealed to the film in a position covering the slits. The film is folded to form a pouch. The contents of the pouch are inserted from the bottom and the pouch is sealed. The pouch and contents are sterilized by a steriliant entering the pouch by way of the porous strip and the slit.

U.S. Pat. No. 5,551,781 (Wilkes) discloses a large sterilizable container having an access slit extending along a front surface thereof substantially from one side to the other at a location close to the top of the package. A porous membrane covers the access slit and a peelable interlayer is disposed between the front surface and the membrane without covering the slit. The contents' are inserted through the side of the container rather than through the access slit.

U.S. Pat. No. 5,868,244 (Ivanov) teaches a vented package wherein a slit-like vent opening 80 is provided with a gas permeable membrane to permit sterilizing gas to flow therethrough to sterilize the interior of the package and for evacuation of the gas after sterilization is complete. A seal is provided to close the vent opening after the sterilization process.

U.S. Pat. No. 4,035,981 (Braun) teaches an aseptic packing method which is of interest because it includes the use of dry radiation for sterilization of packing material. In the method taught by Braun, the packing material is shaped to form a tube that is sterilized by infrared and ultraviolet radiation and filled with a pre-sterilized food substance. The container is then stamped and sealed.

U.S. Pat. No. 4,022,324 (Schuster) teaches a sealed container wherein a breathable cover is bonded to a tray sheet. The cover comprises two panels forming an overlapping region that is covered with a breathable membrane disposed thereupon. The overlap between the two panels and the membrane form a passageway for sterilizing vapor that is impermeable to bacteria.

U.S. Pat. No. 3,783,581 (Pierce) discloses an aseptic packaging machine for packing food having an enclosed sterile chamber containing a plurality of operating stations. In the upper left of FIG. 1A, containers 48 are deposited from container storage hopper 50 and sterilized as they move vertically through the sterilization chamber 46. Thus, the containers are sterilized prior to filling, but they are not sealed at the time of sterilization. The containers are conveyed to a filling station where a sterile product is placed therein and a continuous strip of interconnected covers is placed into position in registry with the containers. The covers are heat sealed to the containers.

Other U.S. patents relating to this topic are: U.S. Pat. No. 3,481,100 (Bergstrom), U.S. Pat. No. 3,532,571 (Ausnit), U.S. Pat. No. 3,761,013 (Schuster), U.S. Pat. No. 3,884,012 (Ernstsson et al.), U.S. Pat. No. 3,947,249 (Egger), U.S. Pat. No. 4,008,851 (Hirsch), U.S. Pat. No. 4,057,144 (Schuster), U.S. Pat. No. 4,194,622 (Lewis), U.S. Pat. No. 4,223,512 (Buchner), U.S. Pat. No. 4,494,357 (DiGeronimo), U.S. Pat. No. 4,524,563 (Sassi), U.S. Pat. No. 4,686,814 (Yanase), U.S. Pat. No. 4,765,118 (Akutsu et al.), U.S. Pat. No. 4,782,646 (Nantin), U.S. Pat. No. 4,979,933 (Runge), U.S. Pat. No. 5,120,993 (van Boxtel), U.S. Pat. No. 5,228,271 (Wallace), U.S. Pat. No. 5,237,799 (van Boxtel), U.S. Pat. No. 5,310,262 (Robison et al.), U.S. Pat. No. 5,378,226 (Hanifl et al.), U.S. Pat. No. 5,606,847 (Joensson et al.), U.S. Pat. No. 5,776,045 (Bodolay et al.), U.S. Pat. No. 6,070,397 (Bachhuber), U.S. Pat. No. 6,079,184 (Cassou et al.), U.S. Pat. No. 6,085,491 (Bois), U.S. Pat. No. 6,098,800 (Bennish, Jr. et al.), U.S. Pat. No. 6,162,158 (Mercer et al.), U.S. Pat. No. 6,413,350 (Boschi), U.S. Pat. No. 6,419,825 (Hahmann et al.) and U.S. Pat. No. 6,510,669 (Bellei et al.). See also published U.S. Patent Application 2003/0014945 (Danby).

BRIEF SUMMARY OF THE INVENTION

This invention relates to flexible packages for use in an aseptic filling and sealing apparatus to seal products within the package under aseptic conditions and systems incorporating such packages and apparatus.

The package of this invention is formed of a flexible material, e.g., a polymeric film of one or more plies or layers, and basically comprises a bottom panel and a pair of top panels. Each of the top panels is secured to respective portions of the bottom panel along marginal edge portions thereof to form a pair of bags or pouches connected together by an intermediate section. Each of the bags or pouches has a hermetically sealed, a top end, a sealed bottom end, and a pair of sealed sides. The top end of each bag or pouch is located immediately adjacent the intermediate section of the package and is initially sealed so that the hollow interior of each of the bags or pouches is sterile. Each of the top ends of the bags or pouches are arranged to be selectively opened within the filling and sealing apparatus under aseptic conditions, whereupon the product can be introduced into the interior of each of the bags or pouches through the opened top ends of each of said bags or pouches. Each of the top panels adjacent the top ends of each of the bags or pouches includes resealable portions arranged to be sealed to said bottom panel after the products are introduced into the interior of the bags or pouches to store the products therein under aseptic conditions.

In accordance with one preferred aspect of this the package of this invention the top end of each of the bags or pouches is in the form of a free edge of the top panel and a respective strip of adhesive tape covers that free edge to initially seal the hollow interior of that bag or pouch. The tapes are removable from those free edges within the apparatus to enable the product to be introduced through the interface between those free edges and the bottom panels, whereupon the top panels of the bags or pouches can be sealed to the bottom panel along the resealable portions to store the products in the bags or pouches under aseptic conditions.

In accordance with another preferred aspect of the package of this invention the top end of each of the bags or pouches is in the form of an edge portion sealed to the bottom panel and a weakened or frangible line, e.g., a laser scored line, located below the sealed edge portion. The resealable portions comprise lines located below the weakened or frangible lines. Each of the weakened or frangible lines is arranged to be opened within the apparatus to enable the product to be introduced therethrough, whereupon the top panels of the bags or pouches can be sealed to said bottom panel along those resealable lines to store the products in the bags or pouches under aseptic conditions.

In accordance with another preferred aspect of the package of this invention, the package comprise a series of releasably connected packages.

The system of this invention basically comprising an aseptic filling and sealing apparatus and a plurality of flexible packages, like those set forth above. The apparatus includes an aseptic chamber into which the packages are introduced, a station including means for opening each of the packages within the aseptic chamber. The apparatus is arranged to introduce the product into the hollow interior of each of the bags or pouches through the opened top ends of each of those bags or pouches. The apparatus is also arranged to seal the resealable portion of the bags or pouches under aseptic conditions after the products are introduced into the interior of those bags or pouches.

In accordance with one preferred aspect of the system of this invention wherein each of the bags or pouches is initially sealed with a respective strip of adhesive tape, the apparatus is arranged to remove those tapes within the aseptic chamber to open said hollow interior of said bags or pouches. The apparatus is also arranged to introduce the product into the open bags or pouches through the interface between the free edges of the top panels of the bags and the bottom panels under aseptic conditions, and also to seal those top panels to the bottom panel along the resealable portions under aseptic conditions.

In accordance with another preferred aspect of the system of this invention wherein the top end of each of the bags or pouches is in the form of an edge portion sealed to said bottom panel and a weakened or frangible line located below the sealed edge portion, and with the resealable portions comprising lines located below the weakened or frangible lines, the apparatus is arranged to open the weakened or frangible lines within the aseptic chamber. The apparatus is also arranged to introduce the product through the opened lines under aseptic conditions and to seal said top panels of the bags or pouches to the bottom panel along the resealable lines under aseptic conditions.

The method of this invention entails filling and sealing products within flexible packages under aseptic conditions by use of an aseptic filling and sealing apparatus. The apparatus is like that set forth above. The method basically comprises: providing a plurality of packages like that set forth above. The packages are introduced into the apparatus, whereupon the opening means of the apparatus opens the top end of each bag or pouch within the aseptic chamber. Then the filling means of the apparatus is operated to introduce the product into the interior of each of the bags or pouches through the opened top ends of each of the bags or pouches under aseptic conditions. Once that has been accomplished the sealing means of the apparatus is operated to seal the resealable portion of the bags or pouches under aseptic conditions.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
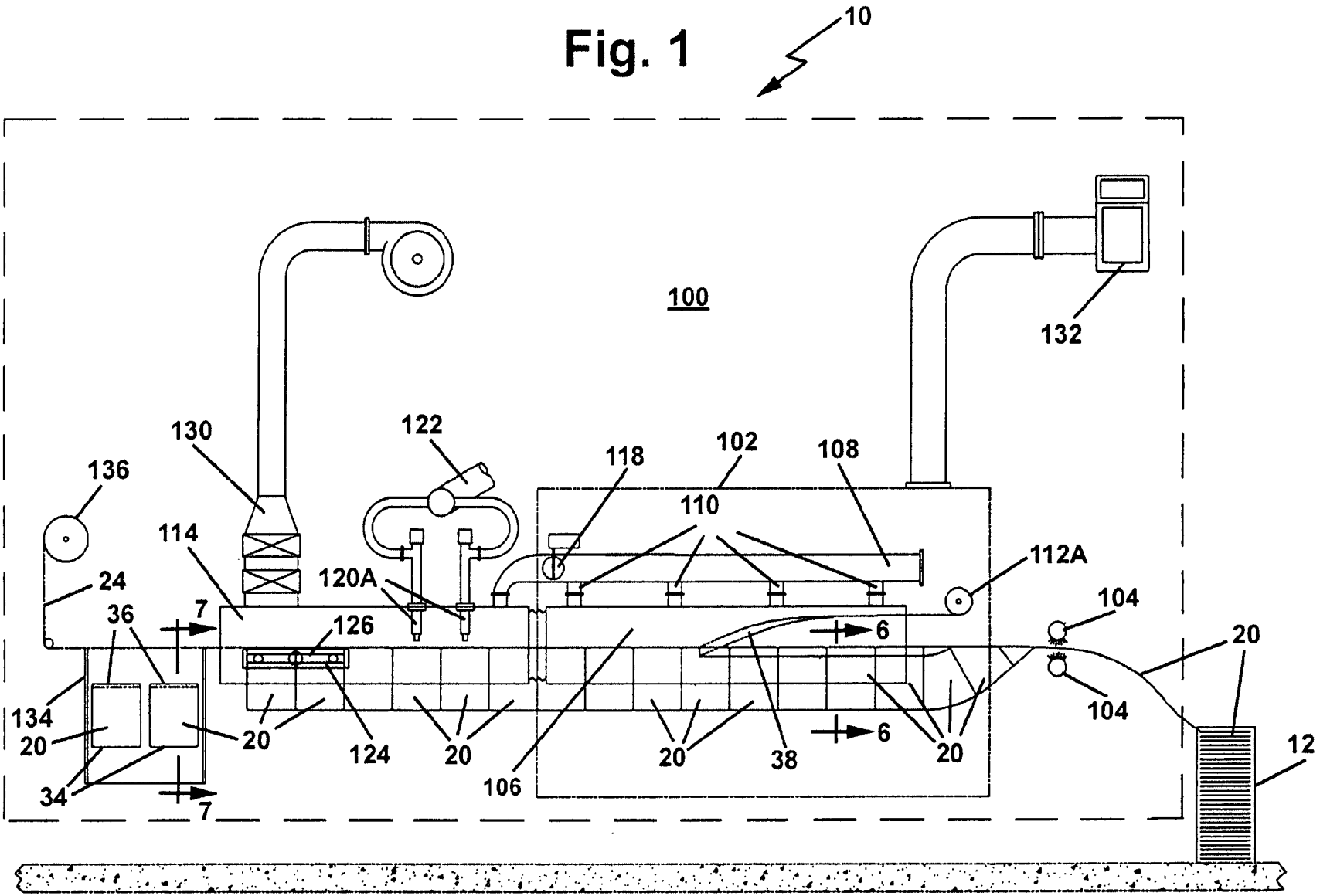
FIG. 1 is a schematic diagram of one exemplary embodiment of a system constructed in accordance with this invention.

Referring now to FIG. 1 there is shown at 10 a system for sealing products within flexible packages under aseptic conditions. The system 10 basically comprises an aseptic filling and sealing apparatus 100 and a plurality of flexible precursor packages 20. The packages 20 are provided from a supply 12, e.g., a carton containing a plurality of serially connected hermetically sealed precursor packages 20. The details of those packages will be described later. Suffice it to say that each package 20 includes a pair of hermetically sealed bags or pouches which have a hollow sterile interior and are arranged to be opened within the apparatus 100. The sterilization of the precursor packages can be accomplished in any conventional manner, e.g., by irradiation with gamma rays. In any case, after opening within the apparatus 100, each of the bags or pouches is filled with the desired product under aseptic conditions and then sealed under such conditions, all within the apparatus 100. The hermetically precursor packages 20 and the apparatus 10 each constitute aspects of this invention, as does the method of aseptically filling an sealing packages using that system or other suitable systems.

Figure 5:
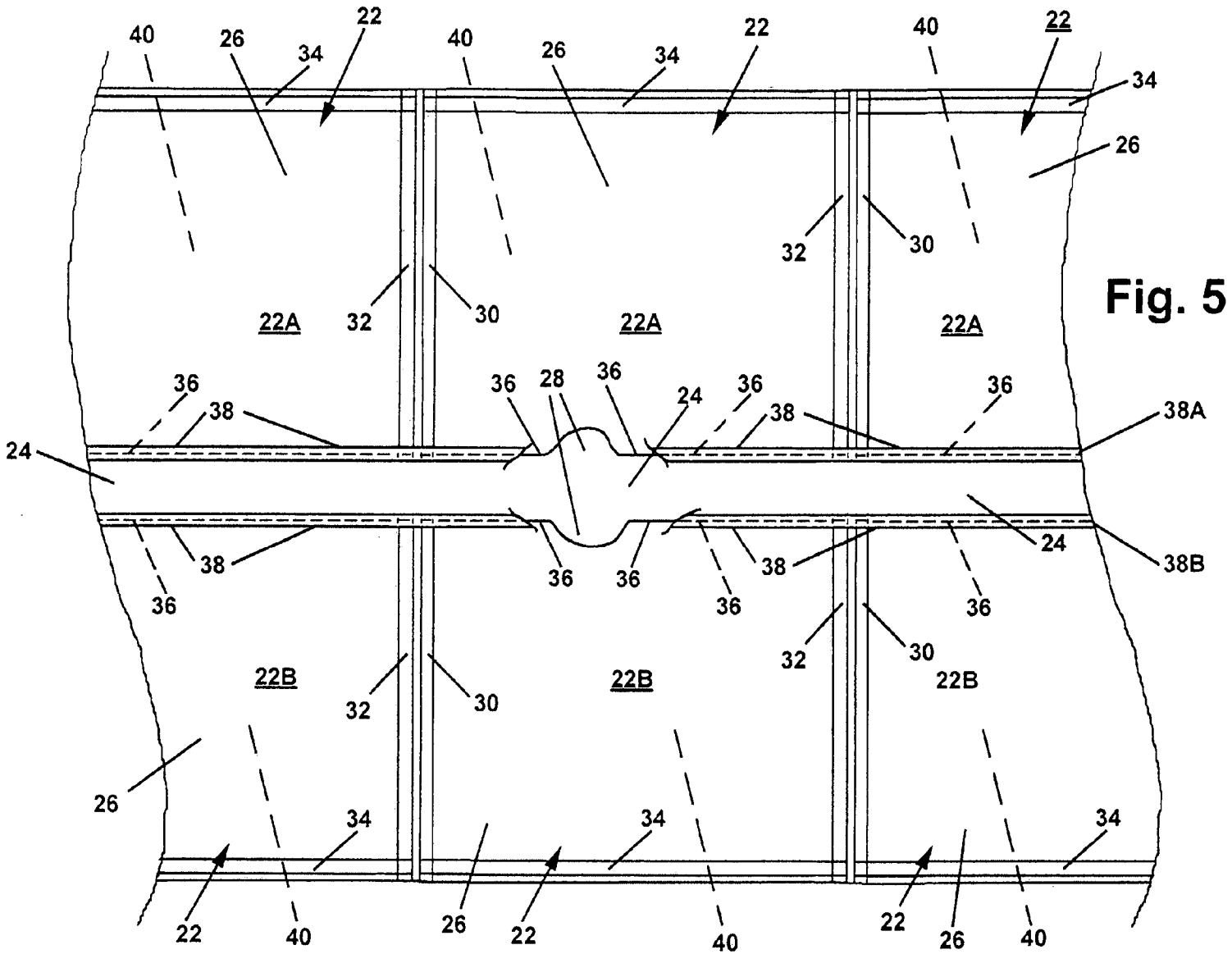
FIG. 5 is a top plan view of a series of "saddle-bag type" flexible packages constructed in accordance with one embodiment of this invention as they are ready to be introduced into the aseptic filling and sealing apparatus of this invention.

Referring to FIG. 5 it can be seen that each precursor package 20 of the serial supply 12 is in the form of a pair of pouches or bags 22A and 22B, each connected by an intermediate section 24 to form an "saddle-bag" like arrangement. In U.S. Pat. No. 5,237,799, whose disclosure is incorporated by reference herein there is shown a saddle bag type package that is similar to that of this invention. However, the saddle bags of the package of this invention are initially sterilized and then hermetically sealed so that their hollow and empty interiors are maintained in a sterile condition so that they can later be filled with any desired product under aseptic conditions. To that end, as will be seen and described later, each of the hermetically sealed sterile bags of the saddle bag packages of this invention are arranged to be readily opened under aseptic conditions for filling with the desired product and then resealed under such conditions to hold the product therein in an aseptic state.

Figures 6, 7, 8, 9:
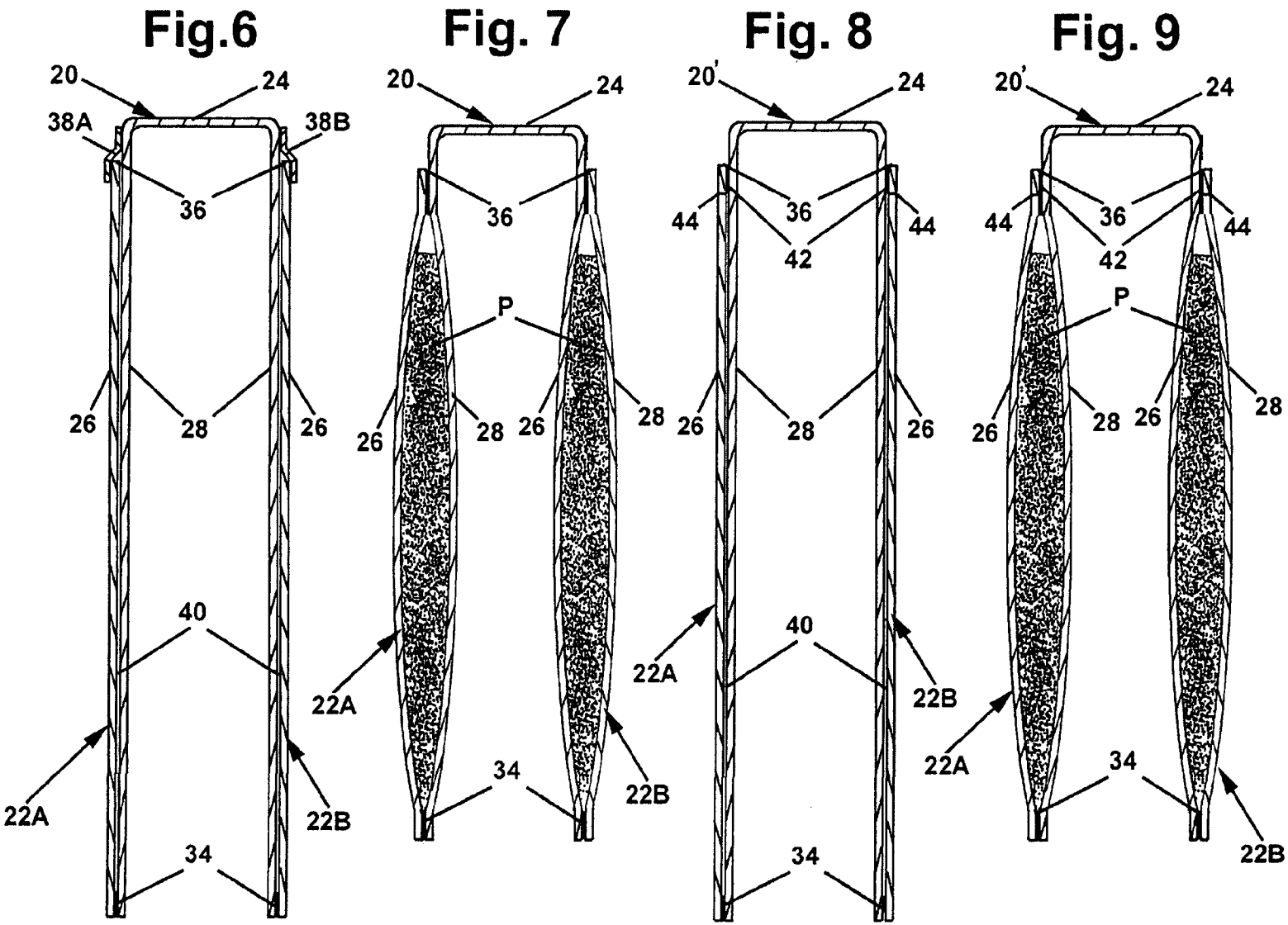
FIG. 6 is a vertical sectional view taken along line 6—6 of FIG. 1 through one of the saddle bag packages like that of FIG. 5, but oriented as it passes through a portion of the apparatus of this invention.
FIG. 7 is a vertical sectional view taken along line 7—7 of FIG. 1, but showing the package after it has been filled and sealed by the apparatus.
FIG. 8 is a vertical sectional view, like that of FIG. 6 through one of the saddle bag packages of an alternative package to that shown in FIG. 5.
FIG. 9 is a vertical sectional view like that of FIG. 7, but showing the package of FIG. 8 after it has been filled and sealed by the apparatus.

Referring now to FIGS. 5 and 6, it can be seen that each of the bags 22 of each package 20 includes a top panel 26 and a bottom panel 28. The top panel 26 of each bag is permanently sealed to the bottom panel 28 along its two side edges 30 and 32, respectively, and along its bottom edge 34. In accordance with one preferred embodiment of this invention, the top edge 36 of each panel 26 is releasably secured to the portion of the intermediate section contiguous with the portion of the bottom panel directly underlying the top panel. To that end, an adhesive tape strip 38 extends across and is adhesively secured to the entire length of top edge of one of the bags while also extending across and being adhesively secured to the contiguous portion of the intermediate section 24. In a similar manner another adhesive strip 38 extends across and is adhesively secured to the entire length of top edge of the other of the bags and also extends across and is adhesively secured to the contiguous portion of the intermediate section 24. The presence of the tape strips 38 across each of the bags of each saddle package 22 ensures that the hollow interior 40 (FIGS. 5 and 6) of each of those bags remains hermetically sealed and sterile.

The fabrication of the supply 12 of precursor packages 20 can be accomplished using any suitable flexible package making technique and equipment involving the sterilization and hermetic sealing of the bags or pouches 22A and 22B. Thus, such action will not be described herein in the interests of brevity.

In accordance with one preferred embodiment of this invention only two tape strips 38 are used for all of the saddle bag packages 20 making up the supply 12, rather than having an individual and separate tape strip closing each bag. To that end, one common tape strip 38A extends across the entire series of bags or pouches 22A on one side of the intermediate section 24 to form the strips 38 that close all of those bags 22A, while another tape strip 38B extends across the entire series of bags or pouches 22B which are located on the opposite side of the intermediate section 24. Each of the unitary tape strips 38A and 38B can be formed of any material suitable for sterilization and for maintaining the interior of the bags under hermetically sealed conditions. Moreover, the adhesive making up those strips is chosen so that it can be readily removed by peeling it off of the portions of the package to which it is initially affixed. In lieu of using adhesive tape strips, like 38A and 38B, each of the strips closing the bags can be formed of a film or some other material which doesn't include any adhesive but which is releasably secured by a layer of adhesive applied to the outer surface of the top panels 26 and the contiguous portion of the intermediate section 24.

It should be pointed out at this juncture, that the top edge portions of each of the bags 22A and 22B, need not be releasably sealed over the entire width of the package. Thus, it is contemplated that one or more portions of the top edge of the top panel is fixedly secured, e.g., welded, to the underlying bottom panel, with the unsecured portion of the top edge being releasably secured by a tape strip 38.

In any case packages 20 constructed as described above are arranged to be readily opened by peeling away or otherwise removing the tape strips 38 so that the package can be filled and sealed through the opened top of the bags 22A and 22B.

In FIG. 8, there is shown an alternative package 20' to the package 20 described heretofore. The package 20' is virtually identical to the package 20 except for the manner that the package is initially hermetically sealed and then opened. Thus, in the interest of brevity the components of the package 20' that are the same as the components of the package 20 will be given the same reference numbers and the details of their construction will not be reiterated.

Figure 2:
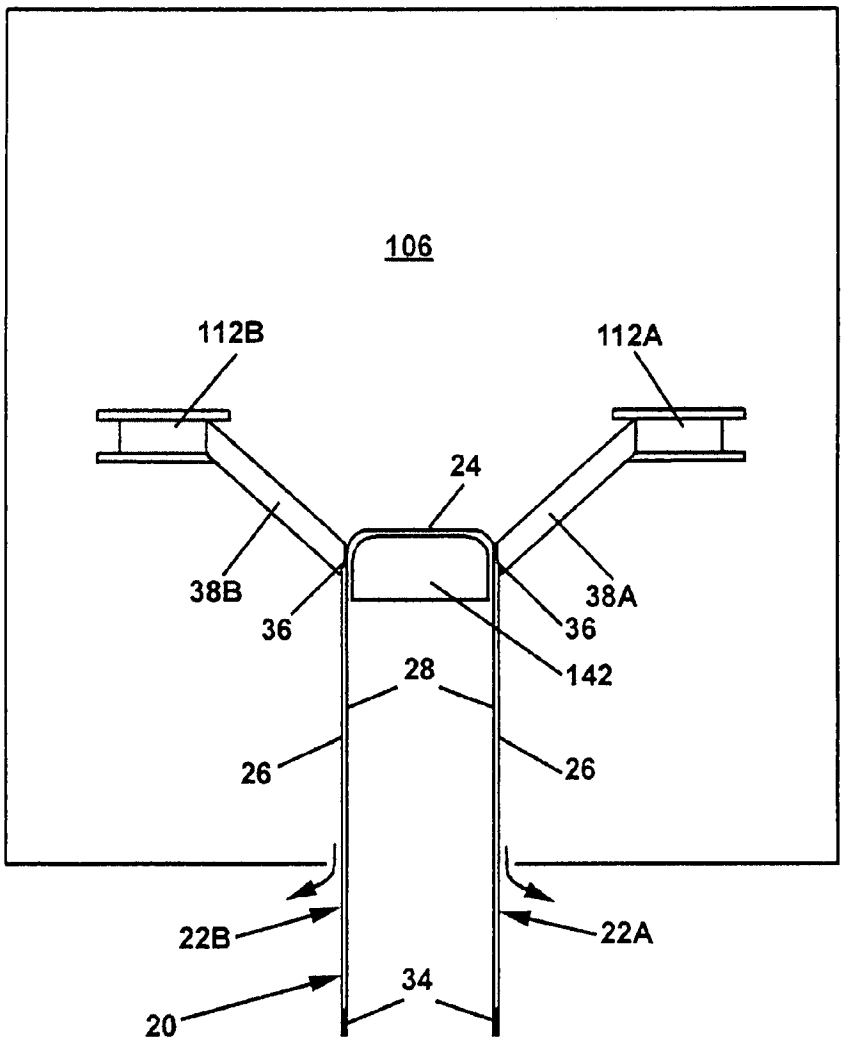
FIG. 2 is a front elevational view of one portion of the system of FIG. 1 that is arranged to effect the opening of the hermetically sealed bags or pouches of one embodiment of the packages of this invention, namely the tape-sealed embodiment shown in FIGS. 5 and 6.
Figure 3:
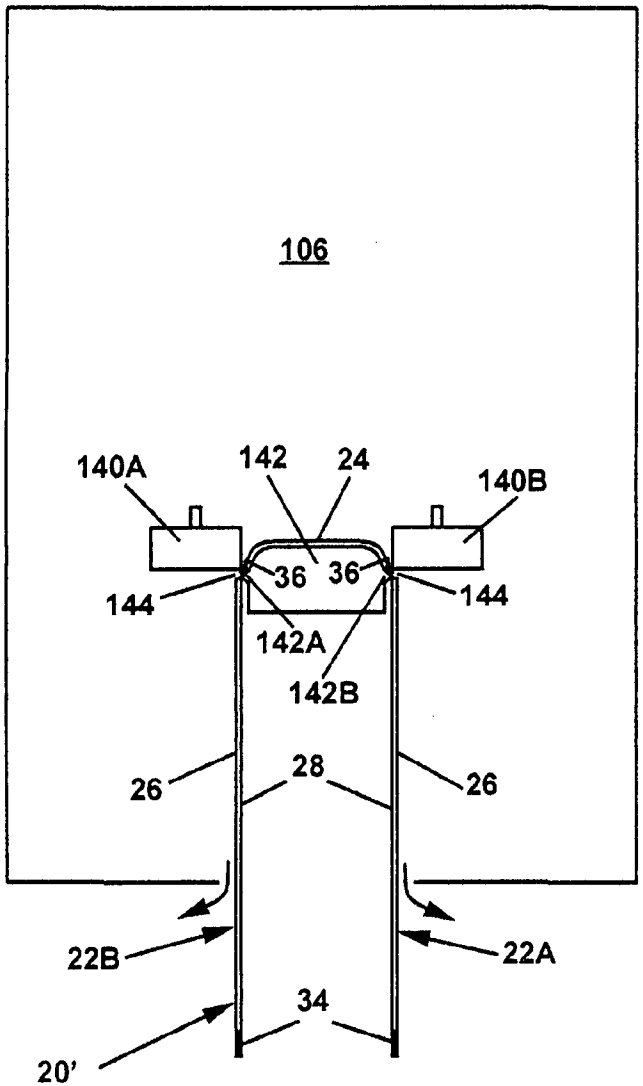
FIG. 3 is a front elevational view of one portion of an alternative system that is arranged to effect the opening of the hermetically sealed bags or pouches of another embodiment of the packages of this invention, namely the laser-scored embodiment shown in FIG. 8.

The top panel 26 of each of the packages 20' is permanently sealed, e.g., heat sealed, welded, adhesively secured, etc., to the bottom panel 28 along a line 42 extending the entire width of the package 20 between the side seals 30 and 32. The seal line 42 is located at or immediately below the top edge 36. As best seen in FIGS. 2 and 3, the portions of the packages 20 and 20' at or immediately below the top edge 36 of each top panel serves as what can be referred to as the resealable portion of the associated bag, while the portion of that top panel contiguous with the resealable portion (i.e., the portion of the top panel immediately below the resealable portion) constitutes what can be called the remaining portion of the bag. A openable, e.g., frangible, line 44 is located in the top panel 26 just below the permanently sealed line 42 to provide an openable access-way to the interior 40 of the package to enable the package 20' to be opened, filled and then sealed. The openable line 44 can extend the full width of the package or only a portion thereof. In accordance with one preferred embodiment of this invention the openable line is a laser scored line. Other techniques can be used to provide a weakened or otherwise openable line in the top panel of the package, in lieu of a laser scored line, so long as the weakened or otherwise openable line is sufficiently strong as to maintain the hermetic seal and sterility of the hollow interior of the package before the package is introduced into the apparatus for opening, filling and sealing its bags.

It should be pointed out at this juncture that the packages described heretofore are merely exemplary of a myriad of different types of packages that can be constructed in accordance with this invention. Thus, this invention contemplates flat pouches, stand up pouches, shaped pouches, pouches with handles, pouches with fitments, tubes or spouts strategically located in the pouch and pouches with special dispensing sections. Moreover, the pouches can be formed of flexible materials having one or my layers or plies of polymeric materials, metals (e.g., foils) or other materials commonly used in the flexible packaging industry.

If the product to be packaged in either package 20 or package 20' is desired to be packaged under aseptic conditions, that can be readily accomplished within the apparatus 100 of this invention or within any other apparatus that can open, fill and seal those packages under aseptic conditions. In particular, when using packages like 20, the apparatus 100 is configured to peel away or otherwise remove the tape strips 38A and 38B under aseptic conditions within the apparatus. Then the opened packages are filled with a food or any other product and sealed, all under aseptic conditions within the apparatus. When using packages like 20', a slightly modified apparatus 100' is provided and is configured to break open the frangible or laser scored line 44.

Referring now to FIG. 1, the details of one exemplary embodiment of the apparatus 100 will now be described. That apparatus basically comprises an enclosure 102 that can be formed of any suitable material, e.g., Lexan® plastic, into which the supply of the serially connected sterilized flexible precursor packages 20 is provided. The packages are provided from a carton 12 (like shown) or a supply reel (not shown) so that they are in the form of a planar web, i.e., the two bags 22A and 22B and the intermediate section making up each serially connected package 20 are all in a common, e.g., horizontal, plane. The packages 20 of the serial supply are drawn into the enclosure 102 by a take-up reel (to be described later). An opposed pair of warm air outlets 104 are located at the entrance to the enclosure 102 to direct warm air onto both the top and bottom surfaces of the web as it enters. This air-flow serves to heat those surfaces in order to get the material to the same temperature as the vapor phase $HO_2$, so that the vapor doesn't condense on the file.

The packages that enter into the chamber 102 are drawn onto a support assembly 108, only a portion of which is shown in FIG. 2. The support assembly is constructed and arranged like that shown and described in U.S. Pat. Nos. 5,210,993 and 5,237,799 or in the heretofore identified GL90 machine, and is located within the chamber 102. As the packages are drawn onto the support assembly the intermediate section 24 of each package 20 is supported in a horizontal plane, while each of the bags 22A and 22B depending from that intermediate section assume a vertical orientation, like shown in FIG. 6.

Heated air and 31% atomized (vapor phase) hydrogen peroxide is introduced into a sterilization chamber 106 located within the enclosure 102 via a main conduit 108 and communicating branch conduits 110 to pressurize the chamber 106 to approximately 0.1 inch of water at temperature of approximately 145° F., thereby sterilizing the exterior portions of the top ends of the bags 22A and 22B of the packages 20. The packages 20 are now ready to have their bags 22A and 22B opened. To that end, a tape removal device, including a pair of tape take-up reels 112A and 112B (FIG. 3), peel the tape strips 38A and 38B, respectively, from the packages 20 as they are pulled through the chamber 106 as best seen in FIG. 3.

The now opened bags 22A and 22B are pulled out of the sterilization chamber and into a filling and sealing chamber 114 making up the filling and sealing section of the apparatus. The chamber 114 is also provided with heated air and the hydrogen peroxide via a conduit 116 that is coupled to the conduit 108. A valve 118 is located in conduit 108 for reasons to be described later. A set of stainless steel opening fingers (not shown) are located within the chamber 114 to pull the bags 22A and 22B open so plural filling valves or tubes can fill the now opened bags. In particular, a pair of filler tubes or valves 120A are located in the filling and sealing chamber 114 and are arranged to be reciprocated into the now open top ends of two serially located bags 22A, to introduce the aseptically processed product P, e.g., food, into the hollow interior 40 of those bags. A similar pair of filling valves or tubes are provided to fill the associated two serial connected bags 22B. The aseptically processed product is provided from a source (not shown) coupled to the filler tubes or valves via a common conduit 122. Once the bags 22A and 22B have been filled, the filling tubes reciprocate, i.e., retract out of the bags, and the package 20 holding the now filled bags is pulled to a sealing station 124 also located within the filling and sealing chamber 114.

The sealing station 124 includes plural pairs of heated sealing bars 126. The one pair of bars are opposed on opposite sides of the bag 22A and a similar pair of bars are opposed on opposite sides of bag 22B. These opposed sealing bars are arranged to be brought together to sandwich the top and bottom panel of the particular bag between them to seal the top edge of the top panel to the underlying portion of the bottom panel. This completes the sealing of the bags 22A and 22B of the package 20, whereupon the package looks something like that shown in FIG. 7. The filling station chamber includes a HEPA filtration system 130 coupled to the interior of the filling and sealing chamber for filtering out any residual sterilization materials before releasing the filtered air to the ambient surroundings. An exhaust fan 132 is provided coupled to the interior of the enclosure 120.

As the series of filled and sealed packages exit the filling and sealing chamber, their bags 22A and 22B are severed from the intermediate section 24, at a cut-off station 134, and the intermediate section is taken up by a take-up reel 136. The cut-off station basically comprises plural knife blades (not shown) which sever the serially connected filled packages 20 from one another by cutting the material making up the bottom panel between the side heat seals 32 of the bags 22A and 22B of the leading package 20 and the side heat seals 30 of the bags 22A and 22B of the next succeeding package 20. The take up reel 132 serves as the means for pulling the series of packages 20 through the apparatus 100.

The resulting bags 22A and 22B are now separate from each other and can be conveyed via a conveyor or some other mechanism (not shown) to a packaging station wherein they are provided in cartons or other shipping containers.

In FIG. 3 there is shown a portion of apparatus 100' for opening, filling and sealing the alternative packages 20' of this invention. The apparatus 100' is identical in all respects to the apparatus 100, except for the means utilized to open the sealed bags 22A and 22B of those packages. Thus, in the interests of brevity, the common components of the apparatus 100 and 100' are given the same reference numbers and the details of their structure and operation will not be reiterated.

As can be seen the bags 22A and 22B of the package 20' are brought into the sterilization chamber 106 where a pair of rollers 140A and 140B are located on opposite sides of a portion 142 of the support apparatus holding the intermediate section 24 of the package 20'. The support apparatus holding the intermediate section 24 of the package between the rollers 140A and 140B includes a pair of outwardly projecting tapered edges 142A and 142B which are aligned with the weakened lines 44 of the bags 22A and 22B. The roller 140A engages the portion of the package contiguous with the weakened laser scored line 44 of the bag 22A to force it against the tapered edge 142A to cause that line to break or rupture. At the same time the other roller 140A engages the portion of the package contiguous with the weakened laser scored line 44 of the bag 22B to force it against the tapered edge 142B to cause that line to break or rupture. Once the package's bags 22A and 22B are opened, the processing of the package continues in the same manner as described with reference to the filling and sealing of the packages 20.

Figure 4:
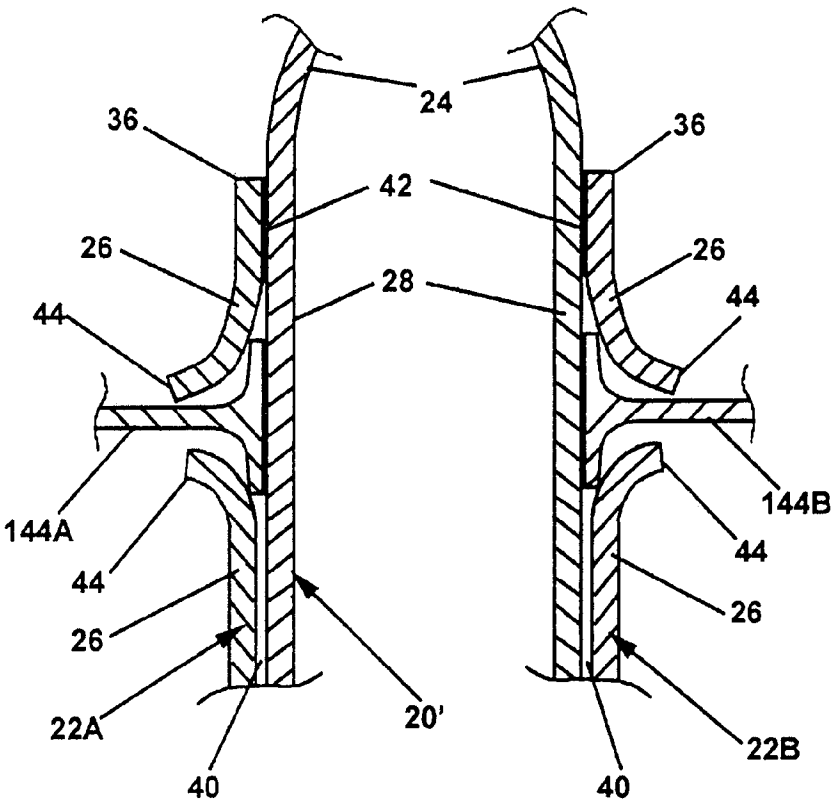
FIG. 4 is an enlarged vertical sectional view showing a portion of yet another alternative system that is arranged to effect the opening of the hermetically laser scored sealed bags or pouches shown in FIG. 8.

In lieu of the rollers 140A and 140B to effect the opening of the weakened laser scored lines 44 of the packages 22A and 22B, the apparatus 100' may includes stationary blunt bars 144A and 144B as shown in FIG. 4. The blunt bars 144A is arranged to open frangible line 44.

The following constitutes a preferred method for effecting the filling and sealing of a series of packages constructed in accordance with this invention, e.g., packages 20 or 20', using the apparatus 100 or 100', respectively, of this invention. As a preliminary step, the apparatus is presterilized using vapor phase hydrogen peroxide and warm-to-hot air. The product delivery portions of the apparatus, e.g., the internal surfaces of the filling station components that will be in contact with the product, and the interface of those portions of the apparatus and the supply for the product, e.g., tanks, vats, vessels, conduits, valves, etc., are also sterilized using steam or superheated water. Other areas of importance for sterilization are the bag-sterilizing chamber 106 and the filling and sealing chamber 114. All functional measurements, determined to be critical factors for creating sterility are monitored continuously and a permanent record of these critical factors is created.

The next step entails what can be referred to as post-sterilization. In particular, after the pre-sterilization has been completed the flow of hydrogen peroxide vapor to the filling and sealing chamber is halted by the closing of the valve 118, but continues to flow to the sterilization chamber 106. Both chambers 106 and 114 will be over-pressurized and monitored as such to maintain their sterile status. Again, all critical factors for maintaining commercially sterility are monitored continuously and a permanent record, assigned to this step, is created.

The next step entails what can be referred to as "production." In particular, the gamma irradiated supply 12 of packages 20 are pulled into the apparatus at the appropriate rate to insure that they receive the proper minimum exposure to hydrogen peroxide vapor. In the sterilization chamber 106 the bags 122A and 122B are opened either through removal of the tape 138 or film (such as occurs with packages 20), or via controlled breaking of a laser score line 44 on the top panels of each of the bags 122A and 122B (such as occurs with packages 20'). The open bags 122A and 122B advance through the sterilization chamber 106 and into the filling and sealing chamber 114, where the set of stainless steel opening fingers pull the bags open so that filling valves can descend into two to four bags. The filling valves open, fill the bags with the product P and then are closed in response to a number of aseptic filler controls options, depending on product consistency and process type. The filled bags 22A and 22B advance from the filing station to the sealing station where a set of mechanical deflator plates or bars (not shown), apply mechanical pressure to the filled bags in such a way so as to remove or substantially reduce residual air volume. Timed with the deflator system, the heated top-seal bars applies heat and pressure to the bag tops for the appropriate time to effect a hermetic seal. The sealed bags 22A and 22B advance out of the sterile filling and sealing chamber 114 to the cut-off station 134 where they are cut free from the intermediate section 24 of saddle bag arrangement and that section is removed, e.g., reeled up on the take-up reel 136. As before, all critical factors for maintaining commercially sterility and that are associated with production are monitored continuously and a permanent record, assigned to this step, is created.

The last step of the process entail what can be called a clean-in-place system. In particular, an integrated "clean in place" subsystem(not shown) automatically cleans all product delivery and process interface piping to be in accordance with industry standards.

As should be appreciated from the foregoing by those skilled in the art, the systems and methods of this invention using the packages of this invention offer various advantages over the prior art. For example, a GL90 machine configured in accordance with the teachings of this invention and utilizing the packaging of this invention (or some other system utilizing the teachings of this invention) should be able to produce finished products at a substantially higher rate than prior art systems. Moreover systems of this invention do not need to incorporate pouch cooling equipment. In this regard, use of a conventional GL90 machine for some aseptic packaging applications, e.g., the very large tomato industry, requires the use of pouch cooling equipment. Such equipment entails a significant capital investment. In contradistinction a GL90 machine configured in accordance with the teachings of this invention and utilizing the packaging of this invention eliminates the need for such cooling equipment. Moreover, the packages of this invention do not require the inclusion of a spout which would otherwise be unnecessary for the package, but which must be included to effect the filling of the package. Further still, a GL90 machine configured in accordance with the teachings of this invention (or some other system utilizing the teachings of this invention) can be used to handle a wide range of bag or pouch types, such as clear pouches, foil barrier pouches, flat pouches stand up pouches, shaped pouches, pouches with handles, pouches with fitments, tubes or spouts strategically located in the pouch and pouches with special dispensing sections. Further still the systems of the subject invention are quite flexible in terms of changeover to accommodate a variety of pouch sizes and shapes as compared to existing technology.

While the invention has been described in detail and with reference to specific examples thereof, it will be apparent to one skilled in the art that various changes and modifications can be made therein without departing from the spirit and scope thereof.

What is claimed is:

1. A precursor package arranged to be filled with a product and aseptically hermetically sealed in an aseptic filling and sealing apparatus to form a completed package, said precursor package having a saddle-bag configuration and formed of a flexible material, said precursor package comprising a bottom panel and a pair of top panels, each of said top panels being of the same general size and shape and being secured to a respective portion of said bottom panel along a respective marginal edge portion thereof to form a pair of bags or pouches connected together by an intermediate section, each of said bags or pouches having an aseptic, hermetically sealed hollow interior, a top end, a sealed bottom end, and a pair of sealed sides, each of said top ends being located immediately adjacent a respective portion of said intermediate section, whereupon said top ends are juxtaposed with respect to each other, each of said top ends being sealed to a respective underlying portion of said bottom panel so that said hollow interior of each of said bags or pouches is sterile and isolated from the ambient atmosphere, each of said top ends of each of said pair of bags or pouches including a respective closed, but openable line arranged to be selectively opened within the apparatus under aseptic conditions, whereupon respective products can be introduced through respective ones of said opened, openable lines of said pair of bag or pouches into respective ones of said bags or pouches, each of said top panels adjacent said top ends of each of said bags or pouches including a resealable portion and a contiguous remaining portion, said resealable portion and said remaining portion of each of said top panels being coplanar in the plane of their respective top panel, each of said resealable portions being inherently juxtaposed over a respective portion of said bottom panel and arranged to be aseptically sealed to said respective portion of said bottom panel at or below a respective one of said releasably openable lines after a respective product is introduced therein.

2. The precursor package of claim 1 wherein said top end of each of said bags or pouches is in the form of a free edge of said top panel, each of said free edges forming a respective one of said openable lines and wherein a respective strip of adhesive tape covers said free edge of each of said bags or pouches to seal the hollow interior thereof, said tapes being removable from said free edges within the apparatus to enable the product to be introduced through the interface between said free edges and said bottom panels.

3. The precursor package of claim 1 wherein said top end of each of said bags or pouches is in the form of an edge portion sealed to said bottom panel and a weakened or frangible line located below said sealed edge portion, said weakened or frangible line forming a respective one of said openable lines, said resealable portions comprising lines located below said weakened or frangible lines.

4. The precursor package of claim 3 wherein said weakened or frangible lines comprise laser score lines.

5. The precursor package of claim 1 wherein said intermediate section is removable from said bags or pouches after said bags or pouches are filled and sealed by the apparatus.

6. The precursor package of claim 2 wherein said intermediate section is removable from said bags or pouches after said bags or pouches are filled and sealed by the apparatus.

7. The precursor package of claim 3 wherein said intermediate section is removable from said bags or pouches after said bags or pouches are filled and sealed by the apparatus.

8. The precursor package of claim 1 wherein said package comprise a series of packages releasably secured to one another.

9. The precursor package of claim 8 wherein said intermediate section is removable from said bags or pouches after said bags or pouches are filled and sealed by the apparatus.

* * * * *